United States Patent [19]

Li et al.

[11] 4,151,125

[45] Apr. 24, 1979

[54] BIOCIDAL ADDITIVE FOR CUTTING FLUIDS

[75] Inventors: Jorge P. Li, Libertyville; John W. Williams, Waukegan, both of Ill.

[73] Assignee: Abbott Laboratories, North Chicago, Ill.

[21] Appl. No.: 801,892

[22] Filed: May 31, 1977

Related U.S. Application Data

[63] Continuation-in-part of Ser. No. 719,039, Aug. 30, 1976, abandoned.

[51] Int. Cl.[2] ..... C10M 3/32; C07C 103/28; A01N 9/12; A01N 9/20

[52] U.S. Cl. ..... 252/47.5; 260/558; 424/324

[58] Field of Search ..... 260/558 S; 252/47.5; 424/324

[56] References Cited

U.S. PATENT DOCUMENTS

| | | | |
|---|---|---|---|
| 2,480,342 | 8/1949 | Nutley et al. | 260/558 S |
| 3,119,877 | 1/1964 | Campbell et al. | 260/47.5 |
| 3,669,902 | 6/1972 | Hirner | 252/391 |
| 3,732,310 | 5/1973 | Huber | 260/569 |
| 3,881,019 | 4/1975 | Wolf et al. | 424/324 |

FOREIGN PATENT DOCUMENTS

| | | | |
|---|---|---|---|
| 69235 | 10/1969 | Fed. Rep. of Germany | 424/324 |

*Primary Examiner*—Winston A. Douglas
*Assistant Examiner*—Raymond Covington
*Attorney, Agent, or Firm*—Paul D. Burgauer; Robert L. Niblack

[57] ABSTRACT

The addition of a 2-mercaptobenzamide to cutting fluid prevents bacterial and fungal growth.

Concentrated solutions thereof in certain organic solvents are also disclosed. One such solution provides additional protection against corrosion of the metal surfaces.

2 Claims, No Drawings

BIOCIDAL ADDITIVE FOR CUTTING FLUIDS

BACKGROUND OF THIS INVENTION

This is a continuation-in-part of our previous application, Ser. No. 719,039, filed Aug. 30, 1976, now abandoned.

DETAILED DESCRIPTION OF THE INVENTION

In most instances involving commercial metal-cutting, the use of a cutting fluid is required. A cutting fluid is an aqueous system containing an additive, the cutting oil, which serves as a heat transfer agent, corrosion inhibitor and lubricant in the cutting operation. Cutting oils may be either emulsifiable oils, straight oils or synthetic fluids. They are added to water at ratios of 1–5 parts by volume to 100 parts water. Large volumes of such fluids are required to serve properly as a heat transfer fluid, and for reasons of economy and potential pollution problems resulting from its discharge, recirculation of this fluid is required. This, in turn, requires that the fluid does not spoil due to biological attack during use or during storage.

While metal deposits can easily be removed from the recirculating fluid by mechanical means, bacterial and fungal contaminants represent more serious difficulties; they could easily ruin an entire system of recirculating cutting fluid which otherwise could be used for months. In order to prevent microbial degradation, the metal cutting industry requires additives that inhibit the growth of bacteria and/or the growth of fungi in the aqueous environment of this fluid. Such an additive preferably dissolves in the cutting fluid, is available as a concentrated stock solution and must not be corrosive to the metallic environment of its storage, circulation and operating area.

It has now been found that compounds of formula

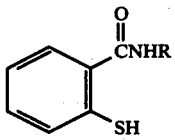

I wherein R is hydrogen or alkyl with 1–8 carbon atoms combine all these exceptional properties: they inhibit, at low concentrations, both industrial bacterial and fungal growth. In addition, they are not corrosive and can be held in a concentrated stock solution in certain organic fluids. They are equally useful in all of the above named types of cutting oils.

A particular aspect of this invention is the provision of a stable liquid composition suitable for use in cutting fluids, containing between 5 and 50% by weight of I in a variety of organic, water-miscible solvents. Such solutions are stable upon extended storage and they can be dissolved, in turn, in the cutting fluid at the desired concentration without requiring particular methods to assure even distribution therein. The solvents resulting in highest stability to storage and use are the water-miscible cyclic ethers, glycols and the highly polar organic amides, i.e. dimethylacetamide, dimethylformamide, N-methylpyrolidone, tetrahydrofuran and dioxane. These solvents are thus the preferred embodiments.

A unique aspect of this invention is the provision of a stable liquid composition containing between 5 and 50% by weight of I in a 4.5–5.5:1 mixture of dimethylacetamide (DMAC) with dicyclohexylthiourea containing 3.5–4.5 parts of the adduct between ethylene oxide and t-octyl- or t-nonylphenol containing 5–15 ethylene oxide groups per molecule. This solution can be dissolved in the cutting fluid at the desired concentrations, and provides additional protection from corrosion of the metal surfaces in contact with the aqueous cutting fluid.

The above mercapto compounds can be made by the route described by Boudet: Bull. Soc. Chem., France, 1956, page 322. They are very unique in their effect against industrial fungi and bacteria. While certain metal chelates or complexes thereof have been proposed for use as bactericides in the animal health field together with a series of other N-substituted analogs, compounds of formula I have now been found to possess the described properties in industrial environments without the need for providing them as salts, chelates or metal complexes, such as suggested by Ponci et al; Farmco, Ed. Sci, 19(3), 246–53 of 1964.

The activity of compounds of formula I against industrial micro-organisms is particularly unusual, as only an extremely small number of compounds tested in metal working fluids prove to be active against both bacteria and fungi.

In order to show the process of using the above compounds, reference is made to the following examples which, however, serve only as illustration and are not meant to limit the invention in any respect.

EXAMPLE 1

In order to show the activity of compounds of formula I against various industrial bacteria and fungi, the minimum inhibitory concentrations (MIC) of these compounds were determined in various cutting fluids. A bacterial and fungal mixture containing Pseudomonas, *E. coli*, Paracolobactrum, Proteus, Klebsiella and Aerobacter (the most common bacteria found in cutting fluids) and Fusarium, Cephalosporium and Cladosporium (the most common fungi found in cutting fluids) was used in this test. The bacteria-fungi mixture was placed in a test tube with a cutting oil, diluted with water to the oil-water ratio used commercially, and the test compound at various levels. The mixture was then incubated for a specific time, after which it was subcultured to (a) a nutrient agar or (b) a potato dextrose agar. In each category, two differing cutting fluids were tested: a petroleum based coolant (Sun-Seco, marketed by the Sun Oil Company of Chicago, Ill.) and a synthetic coolant (Trim-Regular, marketed by the Master Chemical Company of Perrysburg, Ohio). The MIC data for four examples, 2-mercaptobenzamide (I, R=H) and N-methyl-2-mercaptobenzamide (I, R=$CH_3$), is given in Table I.

TABLE I

| | MIC (ppm) In Cutting Fluid Solutions | | | |
|---|---|---|---|---|
| | NUTRIENT AGAR | | POTATO DEXTROSE AGAR | |
| COMPOUND | Sun-Seco | Trim-Regular | Sun-Seco | Trim-Regular |
| I; R=H | 400 | 100 | 400 | 100 |
| I; R=$CH_3$ | 200 | 200 | 200 | 200 |
| I; R=i-$C_4H_9$ | 400 | 800 | 100 | 800 |
| I; R=n-$C_8H_{17}$ | 800 | 800 | 200 | 800 |

EXAMPLE 2

In order to develop a storable concentrate, numerous water-miscible solvents were used to provide a solution containing at least 10% by weight of I (R=$CH_3$). Dioxane, DMAC, DMF, tetrahydrofuran and N-methylpyrrolidone all provide stable solutions at a concentration of 20% or higher. In the case of 2-methoxyethanol or its acetate, diethyleneglycol ethyl ether and the corresponding acetate, a 20% solution is the maximum available concentration. When these concentrates are mixed with water or the highly aqueous emulsion of the normally used cutting fluid, the solutions in dioxane, DMAC, DMF, NMP (N-methylpyrrolidone) and methyl glycol remain in solution, while some of the other organic solution concentrates show a precipitate.

In addition to the above straight solvents, mixtures thereof are equally well suited for providing concentrates of 20% I or higher, which will remain in solution when added to water or cutting fluid at the required concentration of 200–2000 ppm.

EXAMPLE 3

Compound I (R=$CH_3$) was tested in eight cutting fluid solutions using the bacteria-fungi mixture described in Example 1. A 20% solution of I (R=$CH_3$) in NMP was added in the amount of 0.1%, to cutting fluids containing various commercial cutting oils, providing a final concentration of the active ingredient of 200 ppm. Table II shows the days that 200 ppm inhibit the growth of fungi and bacteria in the aqueous cutting fluid solutions (1 part of cutting oil to 40 parts of water).

TABLE II

| CUTTING OIL USED | INHIBITION FOR |
|---|---|
| Norton | 49 Days |
| Shamrock | >105 Days |
| Do All | >105 Days |
| Quaker | >105 Days |
| Texaco | 21 Days |
| IRMCO | 49 Days |
| Polar Chip | >105 Days |
| Shercool | 14 Days |

In all instances where inhibition of growth was for less than 7 weeks, increased levels of concentration of I (R=$CH_3$) provide adequate protection. The above test indicates that after 15 weeks no microbial spoilage is observed in at least half of the tested commercial cutting fluids. In other examples of I, a similar pattern of inhibition at 200 ppm or above is observed.

EXAMPLE 4

A concentrated solution of I in various liquids designed within the framework of claim 1 of U.S. Pat. No. 3,669,902 can easily be obtained. Solutions of this type show the same anti-bacterial and anti-fungal properties as in Examples 1–3 and are miscible with aqueous cutting fluids. However, these solutions have the further advantage of providing protection against corrosion of the metal surfaces by the aqueous cutting fluid system.

A 20% by weight solution of I (R=$CH_3$) in a 5:1 mixture of DMAC with dicyclohexylthiourea containing 4 parts of the adduct between ethylene oxide and t-octyl containing 5–15 ethylene oxide groups per molecule was tested as described in Example 1. It was found that this solution was equivalent in activity against bacteria and fungi to the solutions described in Examples 2 and 3 when tested at a concentration of 200 ppm of I.

EXAMPLE 5

In order to verify the efficacy of the liquid concentrates, 20, 30, and 40% solutions of I (R=$CH_3$) in NMP were tested as described in Example 1. All three solutions provided complete inhibition of the growth of bacteria and fungi at a concentration of 200 ppm of active ingredient. By adding the solid compound I (R=$CH_3$) directly to the cutting fluid, inhibition of growth of bacteria and fungi at 200 ppm was also accomplished, but did not inhibit the growth of yeast in the cutting fluid solution. Thus, besides being a convenient way of adding I to the cutting fluid system, the use of a water-miscible solvent as a means of delivering it to the system provides additional protection against the growth of yeast.

EXAMPLE 6

In a test using a similar parasite mixture of Example 1, several compounds of formula I were screened for their inhibiting properties. In all tests, the compound identified in Table III was used at a concentration of 100 ppm to qualitatively establish their activity at that level.

TABLE III

| COMPOUND | ANTIBACTERIAL | ANTIFUNGAL |
|---|---|---|
| R = H | some growth | none |
| R = ethyl | some growth | none |
| R = n-butyl | growth | none* |
| R = isobutyl | growth | none* |
| R = n-octyl | growth | none |

*Concentrations of 10 ppm also show no growth.

Compositions most practical for use by the consumer are the above described concentrates containing between 10 and 50% of I in the listed solvents. Among the solvents listed, DMAC and the anti-corrosive mixture described in U.S. Pat. No. 3,669,902 are preferred for reasons of economic advantage and additional benefit, respectively. Both of these liquid compositions are easily miscible with water, they are stable for extended storage periods, and they are compatible with all commercial cutting oils used on a large scale. However, other water-soluble, organic, non-corrosive liquids may sometimes be preferred because of other beneficial properties they may have. Typical examples thereof are glycols and glycol ethers which in some instances add to the lubricating qualities of the cutting fluid. Others may be more compatible with the one or the other of the frequently used commercial cutting fluids.

What is claimed is:

1. A stable liquid composition for dissolution in metal working fluids to protect such fluids against industrial micro-organisms containing between 5 and 50% by weight of a mercapto compound of the formula

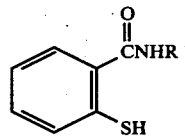

wherein R=H or alkyl containing 1–8 carbon atoms in a mixture of dimethylacetamide with dicyclohexylthiourea in a ratio of 4.5–5.5:1 containing 3.5 to 4.5 parts of the adduct between ethylene oxide and t-octyl- or t-nonylphenol containing 5–15 ethylene oxide groups per molecule.

2. The composition of claim 1 wherein R is alkyl.

* * * * *